US006283766B1

(12) United States Patent
Donnelly et al.

(10) Patent No.: US 6,283,766 B1
(45) Date of Patent: Sep. 4, 2001

(54) MAGNETIC CLAMP DEVICE

(75) Inventors: Thomas F. Donnelly, Hazlet, NJ (US); Michael S. Ruduski, Endicott, NY (US); Glenn M. Brady, Cream Ridge; James V. Canzonier, Point Pleasant Beach, both of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/726,182

(22) Filed: Nov. 29, 2000

(51) Int. Cl.[7] ..... H01R 11/30
(52) U.S. Cl. ..... 439/38; 439/39
(58) Field of Search ..... 439/38, 39, 40, 439/700, 180, 188, 919, 923; 361/144, 214

(56) References Cited

U.S. PATENT DOCUMENTS 4,445,732 * 5/1984 Wafer ..... 439/38
5,829,987 * 11/1998 Fritsch et al. ..... 439/38
5,931,683 * 8/1999 Pinel ..... 439/39
6,007,363 * 12/1999 Renk ..... 439/378
6,030,229 * 2/2000 Tsutsui ..... 439/39

* cited by examiner

*Primary Examiner*—Brian Sircus
*Assistant Examiner*—Chandrika Prasad
(74) *Attorney, Agent, or Firm*—David L. Davis

(57) ABSTRACT

A magnetic clamp device which allows the grounding of a conductive flange of test equipment to a metallic ground plane in a quick and efficient manner. The device includes a top plate and a spring-loaded bar secured to the top plate. The bar is straddled by a pair of magnet assemblies so that when the bar is placed over the conductive flange of the test equipment, the magnet assemblies straddle the flange and are magnetically secured to the ground plane, with the spring-loaded bar pressing the flange into conductive engagement with the ground plane.

9 Claims, 4 Drawing Sheets

MAGNETIC CLAMP DEVICE

BACKGROUND OF THE INVENTION

This invention relates to the field of electromagnetic compliance (EMC) testing and, more particularly, to a device for grounding EMC test equipment in a quick and efficient manner.

Electromagnetic compliance testing is typically done in a specially constructed room having a metal floor which is connected to earth ground. The test equipment must itself be grounded and for that purpose typically is provided with an outer conductive flange which is placed flat against the metal floor and secured thereto. In the past, such grounding has been accomplished either by using a conductive copper tape or by providing a direct mechanical connection. While effective, these ways of grounding the test equipment have proven to be time consuming and the use of copper tape has also proven to cause injuries to test personnel. It would therefore be desirable to have a device which can be used to quickly and effectively ground the conductive flange of the test equipment to the ground plane (i.e., the metal floor).

SUMMARY OF THE INVENTION

According to the present invention, there is provided a device for grounding a conductive flange to a metallic ground plane. The device comprises a top plate and a pair of spaced apart magnet assemblies secured to a first side of the top plate. A bar is provided and mounting structure secures the bar to the top plate between the pair of magnet assemblies. The mounting structure is effective to provide a force which yieldably biases the bar away from the top plate first side. The device is adapted to be placed so that the bar overlies the flange and the pair of magnet assemblies contact the ground plane while straddling the flange. Accordingly, magnetic attraction holds the device to the ground plane and the force applied to the bar by the mounting structure maintains the flange in conductive engagement with the ground plane.

In accordance with an aspect of this invention, the mounting structure includes a rod secured to the bar. The rod extends through an aperture in the top plate so as to be axially slidable therethrough and a helical compression spring surrounds the rod between the bar and the top plate.

In accordance with another aspect of this invention, the device further comprises an operator actuable release mechanism secured to the top plate and adapted, when actuated, to apply a force to the top plate which is directed away from the ground plane. Illustratively, the release mechanism includes an eccentric cam rotatably mounted to the top plate about an axis parallel to the top plate, and a handle coupled to the cam.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
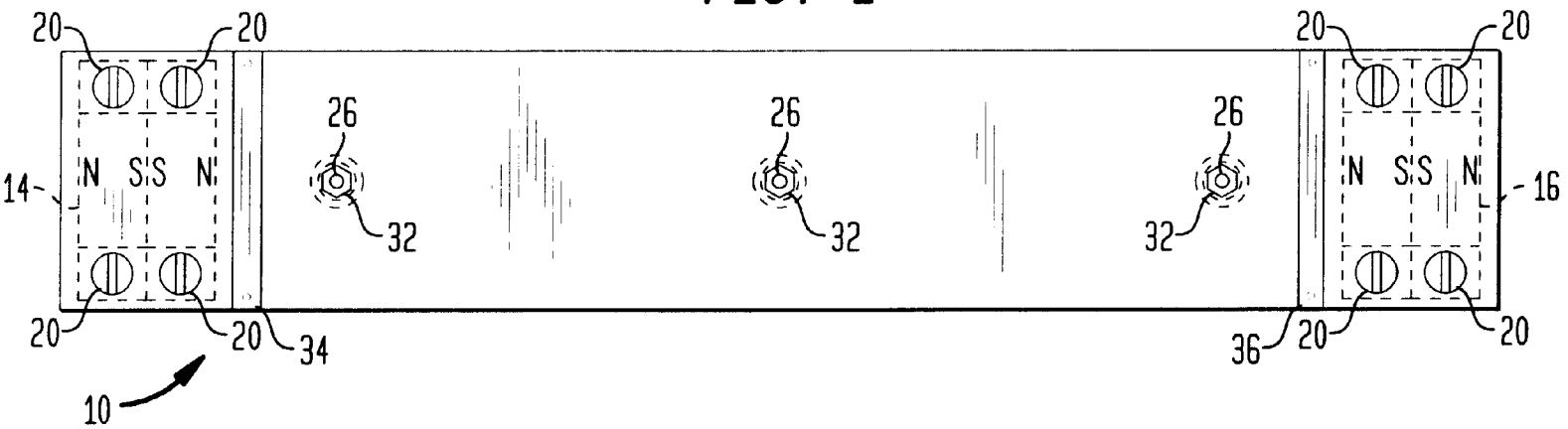
FIG. 1 is a top view of a first embodiment of a device constructed according to the present invention.
Figure 2:
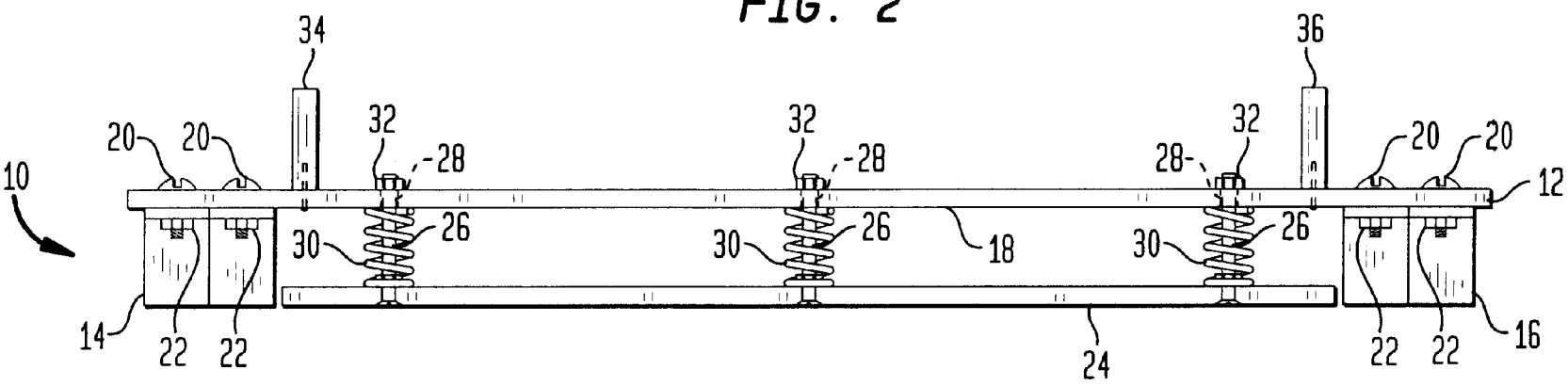
FIG. 2 is a front view of the device shown in FIG. 1.
Figure 3:
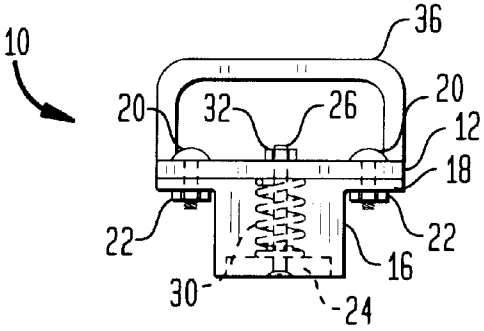
FIG. 3 is an end view of the device shown in FIG. 1.

Referring now to the drawings, FIGS. 1–5 disclose a first embodiment of a magnetic clamp device constructed in accordance with the principles of this invention. The inventive device, designated generally by the reference numeral 10, includes a top plate 12 and a pair of spaced apart magnet assemblies 14, 16 secured to a first side 18 of the top plate 12. Each of the magnet assemblies 14, 16 includes a pair of magnets polarized parallel to the top plate 12 and having like poles abutting each other, as indicated by the letters "N" and "S" in FIG. 1. Illustratively, the magnets of the magnet assemblies 14, 16 are ceramic magnets. The magnet assemblies 14, 16 are secured to the top plate in any desired manner, illustratively by the screws 20 and the nuts 22. Preferably, the magnet assemblies 14, 16 are secured at opposite ends of the top plate 12.

The device 10 further includes a bar 24 which is secured to the top plate 12 by mounting structure which holds the bar 24 between the pair of magnet assemblies 14, 16. The mounting structure is designed to provide a force which yieldably biases the bar 24 away from the first side 18 of the top plate 12. Illustratively, the mounting structure includes a rod 26 secured to the bar 24 and extending through an aperture 28 in the top plate 12 so as to be axially slidable therethrough, and a helical compression spring 30 surrounding the rod 26 between the bar 24 and the top plate 12. Illustratively, the rod 26 is a screw, and a nut 32 is secured to the end of the screw (rod) 26 to hold the assembly of the bar and the mounting structure to the top plate 12. Illustratively, there are three such mounting structures spaced along the bar 24.

Preferably, the top plate 12 and the bar 24 are formed from non-magnetic material.

The device 10 is further provided with a pair of spaced apart handles 34, 36 secured to the top plate 12.

Figure 5:
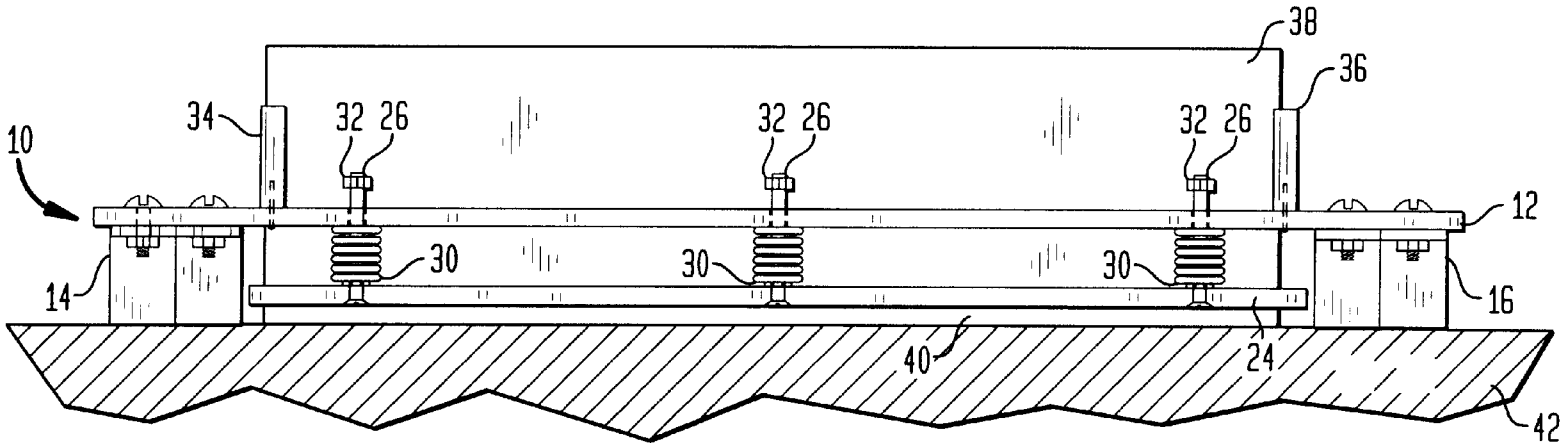
FIG. 5 is a front view of the inventive device and piece of test equipment shown in FIG. 4.
Figure 4:
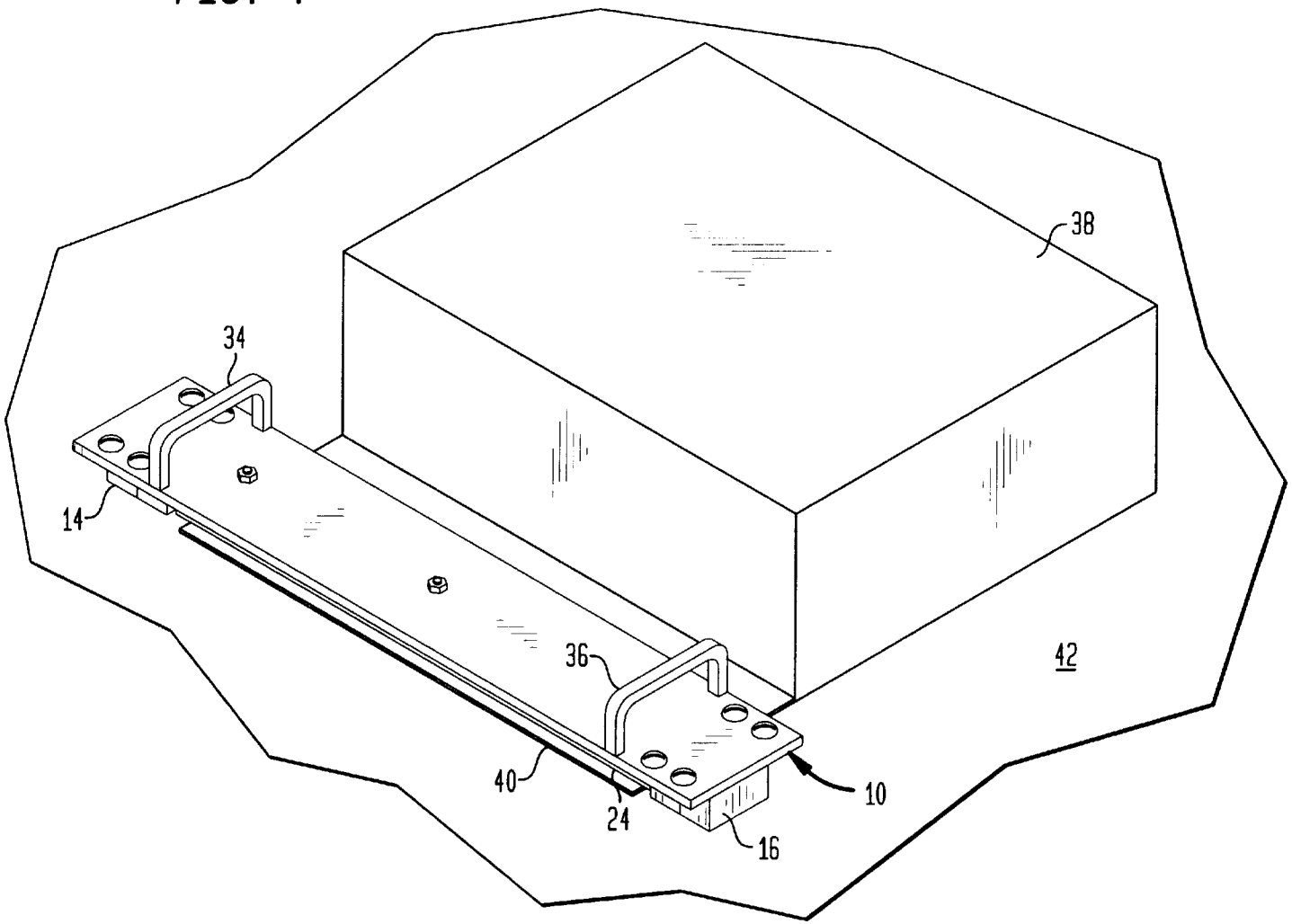
FIG. 4 is a perspective view showing the device of FIG. 1 operating to ground the conductive flange of a piece of test equipment.

FIGS. 4 and 5 illustrate how the inventive device 10 is used. As shown, a piece of test equipment 38 used for EMC measurements has an outer conductive flange 40 which is to be grounded to a metallic ground plane 42. The piece of test equipment 38 is placed on the ground plane 42 with the flange 40 parallel to and in contact with the ground plane 42. The device 10 is then positioned so that the bar 24 overlies the flange 40, with the flange 40 being between the magnet assemblies 14, 16. The magnet assemblies 14, 16 then contact the ground plane 42 while straddling the flange 40. The forces of the magnet assemblies 14, 16 and the springs 30 are selected so that the magnet assemblies 14, 16 contact the ground plane 42 and compress the springs 30, as shown in FIG. 5, with the springs 30 providing a downward force against the bar 24 to establish a 2.5 million maximum interface between the flange 40 and the ground plane 42.

Figure 6:
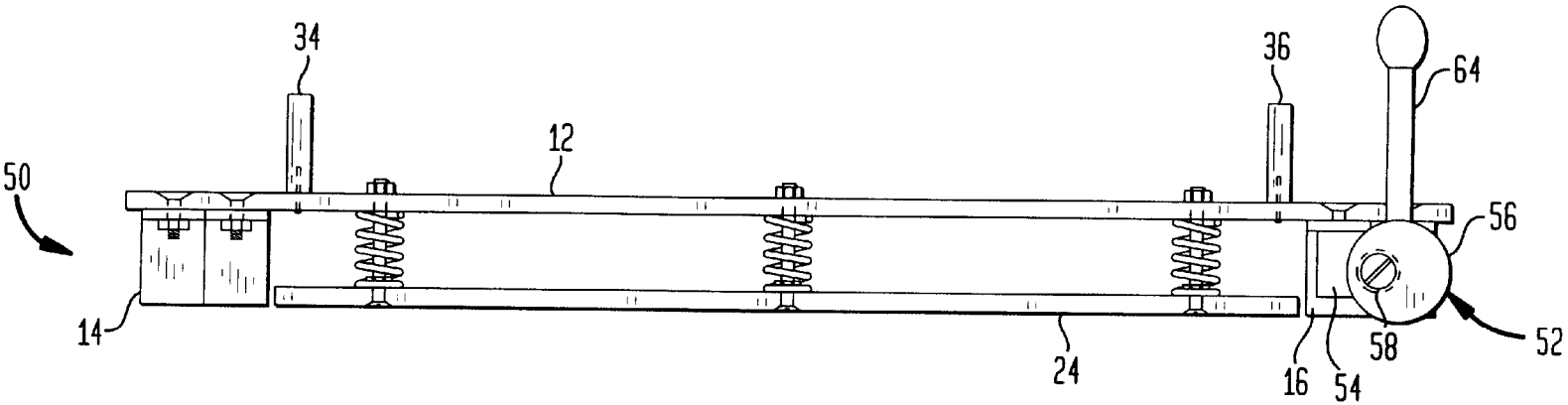
FIG. 6 is a front view of a second embodiment of a device constructed in accordance with the present invention.
Figure 7:
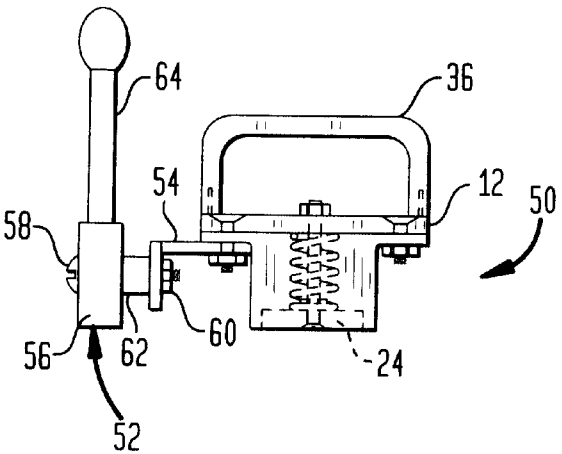
FIG. 7 is an end view of the device shown in FIG. 6.

Since the magnetic attraction between the magnet assemblies 14, 16 and the ground plane 42 is substantial, according to a second embodiment of the present invention a release mechanism is provided. As shown in FIGS. 6 and 7, the modified device, designated generally by the reference numeral 50, is identical to the device 10 in all respects except for the addition of the release mechanism 52. As shown, the release mechanism 52 is secured to the top plate 12 by an angle bracket 54 and includes an eccentric cam 56 mounted to the angle bracket 54 by a screw 58, nut 60 and standoff 62 so as to be rotatable about an axis parallel to the top plate 12. A handle 64 is coupled to the cam 56. Thus, when it is desired to release the device 50 from the ground plane 42, the handle 64 is used to rotate the cam 56 which applies a force to the top plate 12 which is directed away from the ground plane 42. This causes the top plate 42 to pivot and separate the magnet assembly 16 from the ground plane 42, which allows the operator to more easily remove the device 50 from the ground plane 42 by using the handles 34, 36.

Accordingly, there has been disclosed an improved device for grounding EMC test equipment in a quick and efficient manner. While illustrative embodiments of the present invention have been disclosed herein, it will be appreciated by one of skill in the art that various adaptations and modifications to the disclosed embodiments are possible and, accordingly, it is intended that this invention be limited only by the scope of the appended claims.

What is claimed is:

1. A device for grounding a conductive flange to a metallic ground plane, comprising:

a top plate;

a pair of spaced apart magnet assemblies secured to a first side of the top plate;

a bar; and mounting structure securing said bar to said top plate between said pair of magnet assemblies, wherein said mounting structure is effective to provide a force which yieldably biases said bar away from said top plate first side;

wherein the device is adapted to be placed so that the bar overlies the flange and the pair of magnet assemblies contact the ground plane while straddling the flange;

whereby magnetic attraction holds the device to the ground plane and the force applied to the bar by the mounting structure maintains the flange in conductive engagement with the ground plane.

2. The device according to claim 1 wherein each of the pair of magnet assemblies includes a pair of magnets having like poles abutting each other.

3. The device according to claim 2 wherein each of the magnets is polarized parallel to the top plate.

4. The device according to claim 1 wherein said mounting structure includes:

a rod secured to said bar and extending through an aperture in said top plate so as to be axially slidable therethrough; and a helical compression spring surrounding said rod between said bar and said top plate.

5. The device according to claim 1 further comprising:

at least one handle secured to a second side of said top plate.

6. The device according to claim 1 wherein the pair of magnet assemblies are secured at opposite ends of the top plate.

7. The device according to claim 1 further comprising:

an operator actuable release mechanism secured to the top plate and adapted, when actuated, to apply a force to the top plate which is directed away from the ground plane.

8. The device according to claim 7 wherein the release mechanism includes:

an eccentric cam rotatably mounted to the top plate about an axis parallel to the top plate; and a handle coupled to the cam.

9. The device according to claim 1 wherein the top plate and the bar are both formed from non-magnetic material.

* * * * *